US005466514A

United States Patent [19]

Kataoka et al.

[11] Patent Number: 5,466,514

[45] Date of Patent: Nov. 14, 1995

[54] HIGH-DENSITY TEXTILE FABRIC

[75] Inventors: Takayuki Kataoka, Osaka; Ryuji Uemura, Fukui; Shunzo Kawasaki, Mishima; Fumio Shibata, Uji, all of Japan

[73] Assignee: Teijin Limited, Osaka, Japan

[21] Appl. No.: 335,717

[22] PCT Filed: Mar. 15, 1994

[86] PCT No.: PCT/JP94/00414

§ 371 Date: Nov. 10, 1994

§ 102(e) Date: Nov. 10, 1994

[87] PCT Pub. No.: WO94/21848

PCT Pub. Date: Sep. 29, 1994

[30] Foreign Application Priority Data

Mar. 16, 1993 [JP] Japan ..... 5-055587

[51] Int. Cl.[6] ..... D03D 3/00

[52] U.S. Cl. ..... 428/229; 139/383 R; 139/420 R; 427/393.4; 428/225; 428/257; 428/265; 428/266; 428/913

[58] Field of Search ..... 428/225, 229, 428/265, 266, 913, 257; 427/393.4; 139/383 R, 420 R

[56] References Cited

U.S. PATENT DOCUMENTS 4,548,848 10/1985 Shibata et al. ..... 428/85

FOREIGN PATENT DOCUMENTS 61-108748 5/1986 Japan .
63-105139 5/1988 Japan .
63-235572 9/1988 Japan .
648098 2/1989 Japan .
2216238 8/1990 Japan .
9421848 9/1994 WIPO .

OTHER PUBLICATIONS

Derwent Abstract AN 85–219581 of JP–A–60 139 847.
Aoki Kiyoshi, et al., Air–Permeable and Waterproof Cloth, Patent Abstract of Japan (JP–A–05 059633), Mar. 9, 1993.
Partial English language translation of the "Industrial Fiber Material Hand Book", edited by Industrial Fiber Material Research Society, p. 24.

*Primary Examiner*—James J. Bell
*Attorney, Agent, or Firm*—Sherman and Shalloway

[57] ABSTRACT

A high-density textile fabric produced by arranging, as warps and wefts, identical or different continuous filaments yarn at least 40% by weight of which are formed of filaments having a filament denier of 1.1 or less and which have a total denier of 120 or less, wherein cross-sectional overlaying coefficients, $W_p$ and $W_f$, of the warps and wefts constituting said textile fabric simultaneously satisfy the following (a) and (b).

(a) $1.30 \geqq W_p \geqq 1.10$ (b) $1.20 \geqq W_F \geqq 0.85$

Since the high-density textile fabric of the present invention not only exhibits high tearing strength but also has excellent water resistance performance in spite of its small thickness and light weight, it can be widely used not only as a closing material for ski wear, windbreakers, outdoors wear, coats, working clothes and operating gowns, but also for a shower curtain, a table cloth and a piece of cloth for an umbrella.

11 Claims, 4 Drawing Sheets

HIGH-DENSITY TEXTILE FABRIC

TECHNICAL FIELD

The present invention relates to a high-density textile fabric. More specifically, it relates to a high-density textile fabric having a small thickness and a light weight and having high tear strength and excellent water resistance performance (resistance to water pressure).

TECHNICAL BACKGROUND

A high-density textile fabric is conventionally widely used as a general clothing material or sportswear material required to be water-resistant or as a clothing material such as a quilt tick of a bedding.

In the use of sportswear in particular, the demands thereof are increasing year after year with the popularization of outdoor sports activities, and the demand for improvement in the water resistance property is increasing.

To cope with the above demands, there have been proposed various methods of increasing the density of a textile fabric by decreasing the denier of filament constituting filaments yarn or by increasing the weaving density.

For example, U.S. Pat. No. 4,548,848 discloses a high-density, water-repellent textile fabric comprising warps and wefts formed of continuous filaments yarn having a filament denier of 1.2 or less, a total of cover factors in the warp and weft directions being from 1,400 to 3,400.

Further, Japanese Laid-open Patent Publication No. 216238/1990 discloses a high-density textile fabric having a structure in which the crimp in one direction of warps and wefts is greater than that in the other, and filaments crossing at right angles with the filaments having the greater crimp are mutually overlaid one on another.

In the textile fabrics of the above two prior art documents, the weaving density of warps or wefts alone is only increased, and there is therefore a problem in that the warp/weft balance is poor and that, when said textile fabric is treated to impart it with water repellency, the so-treated textile fabric does not satisfy the practically required resistance to water pressure (1,000 mm water column) when used as a piece of water-resistant cloth.

Further, it has been said that, when the density of a textile fabric is increased, the restraint on warps and wefts is increased so that yarns do not easily slide and a tearing stress focuses on a few yarns when a tear force is exerted, and that as a result the apparent tearing strength of the textile fabric decreases (e.g., "Industrial Fiber Material Hand Book", page 24, FIG. 1–17, compiled by Japan Fiber Machinery Society, Industrial Material Research Society).

In particular, the above phenomenon clearly appears when the total denier of a constituting filaments yarn is decreased for increasing the denseness of a textile fabric, and it has been difficult to obtain a high-density textile fabric having no problem in practical tearing strength.

That is, it has not been possible to obtain any high-density textile fabric which not only retains practically acceptable tearing strength but also has high resistance to water pressure, i.e., a high-density textile fabric having both high tearing strength and high resistance to water pressure.

DISCLOSURE OF THE INVENTION

It is an object of tile present invention to overcome the above antinomy and provide a high-density textile fabric which is imparted with excellent water resistance performance without decreasing the tearing strength.

The present inventors have made diligent studies to overcome the above problem, and have found that a high-density textile fabric which is free of a decrease in tearing strength and has high resistance to water pressure can be obtained by keeping the overlaying of warps and wefts constituting the textile fabric, in a constant relationship when the high-density textile fabric is produced by weaving.

According to the present invention, there is provided a high-density textile fabric produced by arranging, as warps and wefts, identical or different continuous filaments yarn at least 40% by weight of which are formed of filaments having a filament denier of 1.1 or less and which have a total denier of 120 or less, wherein cross-sectional overlaying coefficients, $W_p$ and $W_f$, of the warps and wefts constituting said textile fabric simultaneously satisfy the following (a) and (b), $$(a)\ 1.30 \geqq W_p \geqq 1.10$$

$$(b)\ 1.20 \geqq W_F \geqq 0.85$$

(wherein the cross-sectional overlaying coefficients, $W_p$ and $W_f$, are defined as follows;

$$W_p = W_{1f}/W_{0f}$$

$$W_f = W_{1p}/W_{0p}$$

$W_{0f}$: a width of minimum repeating units in a cross section of a textile fabric along a bisecting line in the length direction of any wefts in the minimum repeating units of the textile fabric, $W_{1f}$: a sum of widths of warps contained in the minimum repeating units in the cross section of the above $W_{0f}$, $W_{0p}$: a width of minimum repeating units in a cross section of a textile fabric along a bisecting line in the length direction of any warps in the minimum repeating units of the textile fabric, $W_{1p}$: a sum of widths of wefts contained in the minimum repeating units in the cross section of the above $W_{0f}$.

PREFERRED EMBODIMENTS FOR WORKING THE INVENTION

Figure 1:
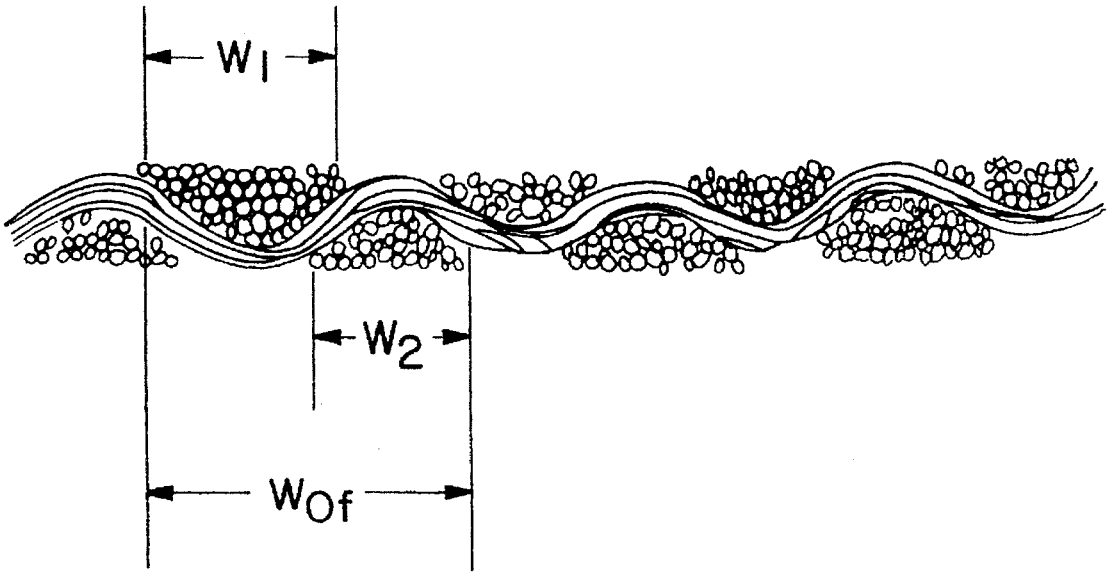
FIG. 1 is a cross-sectional view of a textile fabric, taken in the direction crossing at right angles with warps, which view is to explain the cross-sectional overlaying coefficient, $W_p$, of warps.

The present invention will be detailed hereinafter.

The warps and wefts constituting the high-density textile fabric of the present invention are to satisfy preconditions that all the warps and wefts are formed of continuous filaments yarn at least 40% by weight, preferably at least 65% by weight, of which are formed of filaments having a filament denier of 1.1 or less, preferably 0.5 or less, and which have a total denier of 120 or less, preferably 100 or less. On the other hand, the lower limit of the filament denier is preferably 0.02, more preferably 0.05. Further, the lower limit of the total denier is preferably 10, more preferably 20.

When the constitution ratio of the fibers having a filament denier of 1.1 or less is less than 40% by weight, or when the total denier exceeds 120, the denseness of the textile fabric decreases, and the resistance to water pressure decreases. Furthermore, the textile fabric feels stiff and is not suitable for use as a clothing material required to have water resistance property.

Other fibers constituting less than 40% by weight of the continuous filaments yarn preferably have a filament denier of from more than 1.1 to 3 or less, more preferably from more than 1.1 to 2 or less.

The above continuous filaments yarn include multifilament flat yarns of thermoplastic synthetic fibers, false-twisted yarns and commingled yarns formed of multifilaments of at least two types having different properties.

The continuous filaments yarn constituting the warps and the continuous filaments yarn constituting tile wefts may be the same or different.

Further, the cross-sectional overlaying coefficients, $W_p$ and $W_f$, of the warps and wefts constituting the high-density textile fabric of the present invention are required to satisfy the following (a) and (b).

(a) $1.30 \geqq W_p \geqq 1.10$, preferably $1.30 \geqq W_p \geqq 1.15$ (b) $1.20 \geqq W_F \geqq 0.85$, preferably $1.20 \geqq W_F \geqq 0.90$ wherein the cross-sectional overlaying coefficients, $W_p$ and $W_f$, are defined as follows.

$$W_p = W_{1f}/W_{0f}$$

$$W_f = W_{1p}/W_{0p}$$

Further, in the above equations, $W_{0f}$, $W_{1f}$, $W_{0p}$ and $W_{1p}$ are defined as follows.

$W_{0f}$: a width of minimum repeating units in a cross section of a textile fabric along a bisecting line in the length direction of any wefts in the minimum repeating units of the textile fabric, e.g., a width of 2 warps when the textile fabric is a plain weave, a width of 4 warps when it is a 2/2 twill weave, and a width of 5 warps when it is a 5-harness satin, provided that said width refers to an average value of those in three different repeating units.

$W_{1f}$: a sum of widths of warps contained in the minimum repeating units in the cross section of the above $W_{0f}$, provided that said width refers to an average value of those in three different repeating units.

$W_{0p}$: a width of minimum repeating units in a cross section of a textile fabric along a bisecting line in the length direction of any warps in the minimum repeating units of the textile fabric, e.g., a width of 2 warps when the textile fabric is a plain weave, a width of 4 warps when it is a 2/2 twill weave, and a width of 5 warps when it is a 5-harness satin, provided that said width refers to an average value of those in three different repeating units.

$W_{1p}$: a sum of widths of wefts contained in the minimum repeating units in the cross section of the above $W_{0f}$, provided that said width refers to an average value of those in three different repeating units.

For example, FIG. 1 shows a cross-sectional view of a plain weave, taken in the direction crossing at right angles with the warps, for explaining the cross-sectional overlaying coefficient of warps, in which $W_{0f}$ is a maximum width of two warps which constitute the minimum repeating unit of the plain weave structure, $W_1$ and $W_2$ are maximum widths of warps contained in said repeating unit, and $W_{1f}$ is determined from $W_{1f} = W_1 + W_2$.

The cross-sectional overlaying coefficient, $W_f$, of wefts is also determined on the basis of the cross section of a textile fabric, taken in the direction crossing at right angles with wefts, in the same manner as in the determination of $W_p$.

Figure 2:
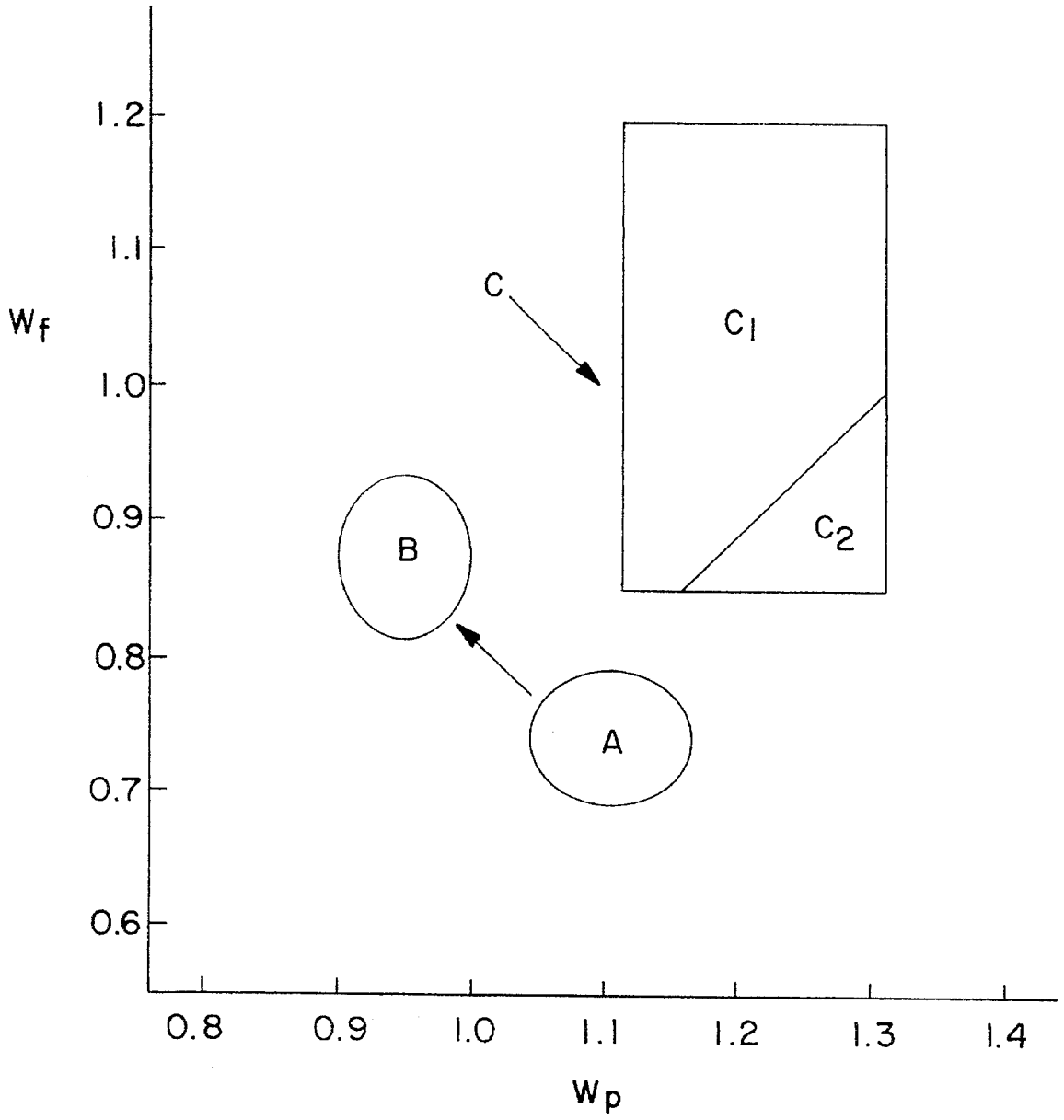
FIG. 2 is a graph showing the relationship between the cross-sectional overlaying coefficient, $W_p$, of warps and the cross-sectional overlaying coefficient, $W_f$, of wefts.

FIG. 2 is a graph showing the relationship between $W_p$ and $W_f$, and the high-density textile fabric of the present invention has $W_p$ and $W_f$ in the range C shown in FIG. 2.

That is, in the high-density textile fabric of the present invention, the values of $W_p$ and $W_f$ are controlled to come under the range C in FIG. 2 by using continuous filaments yarn, at least 40% by weight of which are formed of filaments having a filament denier of 1.1 or less and which have a total denier of 120 or less. As a result, the high-density textile fabric of the present invention has sufficient denseness both in the warp and weft directions and has a well warp/weft balance. Therefore, it has high resistance to water pressure.

In contrast, in conventional high-density textile fabrics including those textile fabrics disclosed in the foregoing U.S. Pat. No. 4,548,848 and Japanese Laid-open Patent Publication No. 216238/1990, since the textile fabrics as a whole are improved in density by mainly improving the density in warp direction, their $W_p$ and $W_f$ are, for example, in the range A shown in FIG. 2. Therefore, these textile fabrics are insufficient in denseness in the weft direction, and no sufficient resistance to water pressure can be obtained.

The reason therefor is that it is technically difficult in many ways to increase the density of a textile fabric in the weft direction, and if attempt are made to increase the density in the weft direction, tile density in the warp direction in turn decreases to a great extent. In this case, the $W_p$ and $W_f$ shift, for example, to a range B shown in FIG. 2.

It has been so far possible to increase the density only in one direction, the warp or weft direction, and there have been obtained no textile fabrics having sufficient denseness both in the warp and weft directions like the high-density textile fabric of the present invention.

In the present invention, sufficient resistance to water pressure can be imparted to a textile fabric by setting the $W_p$ and $W_f$ in the above ranges. Moreover, although continuous filaments yarn having a total denier of 120 or less are used, the tearing strength of the textile fabric can be maintained at high levels.

That is, in the high-density textile fabric of the present invention, adjacent warps (and wefts) are mutually overlaid one on another. Therefore, a number of yarns receive a tearing stress simultaneously, and the tearing strength against the breakage of the yarns increases. The apparent tearing strength, which conventionally decreases with an increase in the density, is greatly improved both in the warp and weft directions.

The present invention includes a portion where wefts are not mutually overlaid (a portion of $0.85 \leqq W_f \leqq 1.0$). However, it has been found that since the tension of the warps is very high as will be described later, the warps behave against a tearing force integrally with the wefts so that a tearing strength of 1,000 g can be secured in the above portion.

Figure 3A:
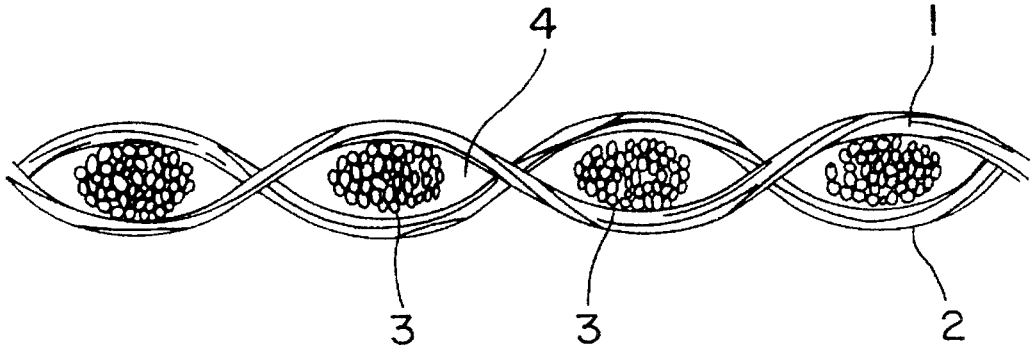
FIG. 3 is a cross-sectional view of a textile fabric, taken in the direction crossing at right angles with wefts, which view is to explain the mutual actions of warps and wefts.
Figure 3B:
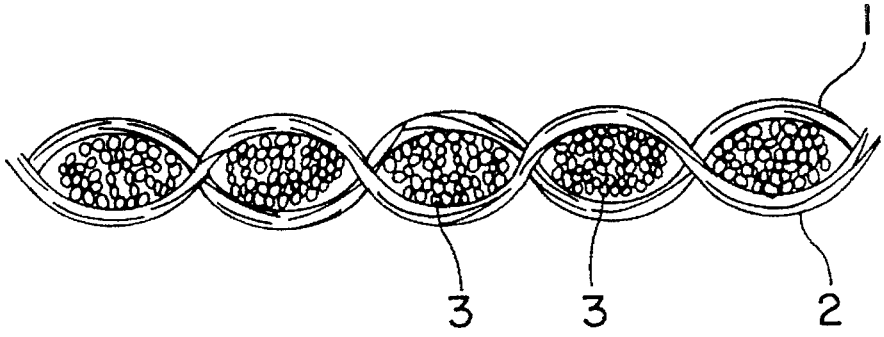

The reason therefor is as follows: In the case of a usual tension of warps ($W_f$ is less than 0.85), as shown in FIG. 3 (*a*), a gap 4 is generated among adjacent warps 1 and 2 and a weft 3, and the warps and weft behave independently. In the present invention, however, the tension of warps is very high, and as shown in FIG. 3 (*b*), there is almost no gap 4, and the warps and weft behave integrally.

The above finding has been obtained for the first time by establishing the following weaving technique for increasing the overlaying of warps (wefts) of high-density textile fabric up to its limit, and due to the use of this weaving technique, a high-density textile fabric having high resistance to water pressure can be obtained without decreasing the tearing strength.

Further, even if $W_p$ and $W_f$ satisfy the above values, when the $(W_p-W_f)$ value exceeds 0.3 (a range of $C_2$ in FIG. 2), the warp/weft balance of a textile fabric tends to be broken so that the resistance to water pressure and tearing strength decrease. Therefore, the $(W_p-W_f)$ value is preferably 0.3 or less (a range of $C_1$ in FIG. 2).

The continuous filaments yarn used for the high-density textile fabric of the present invention are preferably multifilaments formed of a polyester, and the polyester is advantageously a polyester having at least 80 mol % of ethylene terephthalate units based on the total of recurring units.

The above high-density textile fabric of the present invention is obtained, for example, by a method in which polyester multifilament yarns at least 40% by weight, preferably at least 65% by weight, of which are formed of filaments having a filament denier of 1.1 or less, preferably 0.5 or less, and which have a total denier of 120 or less, preferably 100 or less, are arranged as warps and wefts, and woven while the tension of the warps is increased so that it is at least twice as large as a conventional one (0.3 g/denier at the highest) and the total of cover factors (CF) in the warp and weft directions is set at 1,800 to 3,500.

The above cover factor (CF) is determined in accordance with the following equation.

$$CF = n\sqrt{de}$$

wherein n is the number of warps or wefts of a textile fabric per inch and de is the denier of the warps or wefts of the textile fabric.

In the textile fabric of the present invention, the total of the cover factors (CF) in the warp and weft directions is 1,800 to 3,500, preferably 2,000 to 3,500.

In this case, the number of twists of the multifilament yarn used is preferably 300 T/m or less, and more preferred is a flat yarn which is in a substantially non-twisted state.

The above "substantially non-twisted state" refers to a state in which yarns are not actively twisted by the process of twisting and are only imparted with unintended twisting such as unwinding twist.

Further, the above multifilament yarn may be any one of a yarn having a crimp imparted by false-twisting and a commingled yarn obtained by combining, for example, multifilaments of at least two types having different heat shrinkage according to a known method such as an aligning, doubling or air-entangling method.

As a method for increasing the tension of warps, there may be employed a method in which the difference between the take-up rate of a back roller of a weaving machine and that of a press roller of the weaving machine is increased.

Figure 4:
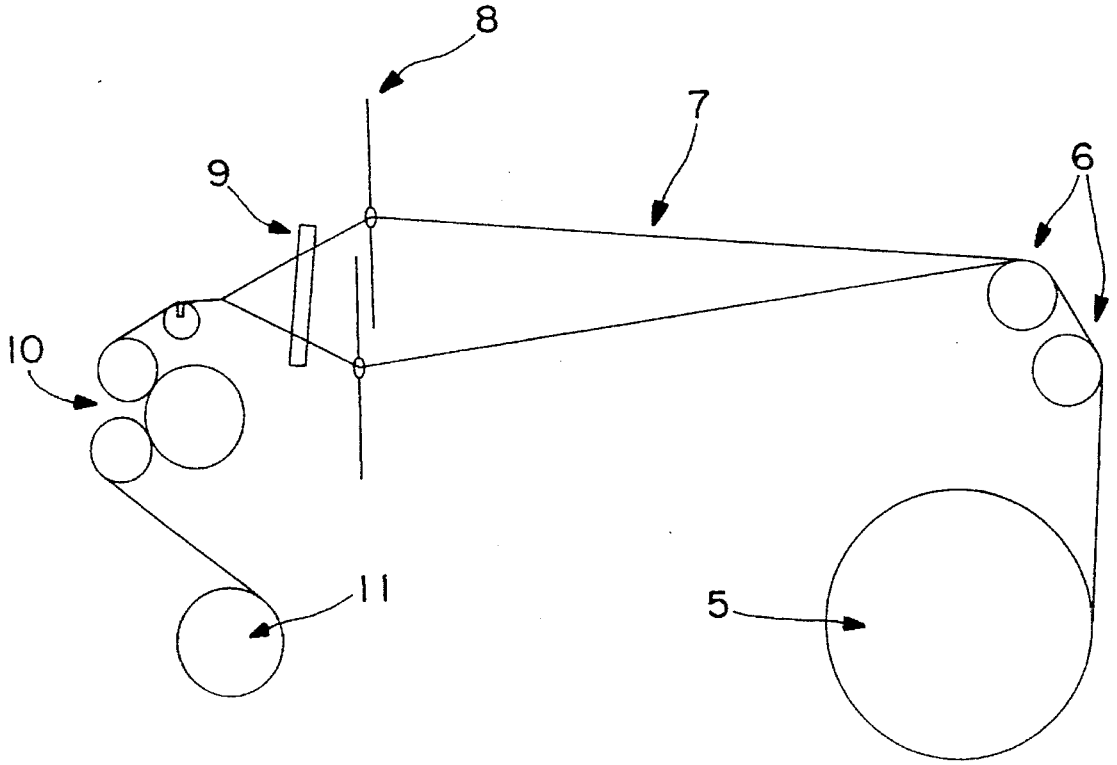
FIG. 4 is a schematic view showing one embodiment of the structure of a weaving machine for producing a high-density textile fabric of the present invention.

FIG. 4 is a schematic view of one embodiment of the structure of a weaving machine for producing the high-density textile fabric of the present invention by increasing the tension of warps, in which 5 indicates a beam, 6 indicates a back roll, 7 indicates a warp, 8indicates a heald, 9 indicates a reed, 10 indicates a press roll, and 11 indicates a cross roll.

In the present invention, the tension of the warp 7 is increased by using back roll 6 and the press roll 10 having diameters, for example, at least 1.5 times as large as those (about 100 mm at the largest) of conventional ones for taking up a textile fabric without causing the slipping, and increasing the difference between the take-up rates of these two rollers.

The tension value may be properly set depending upon the denier of the multifilament used and the weaving density, while it is required to apply a tension of 0.35 to 0.9 g/denier, preferably 0.4 to 0.7 g/denier, per warp.

As described already, increasing the density of a textile fabric in the weft direction is technically difficult in many ways as compared with increasing the density of a textile fabric in the warp direction.

That is, for increasing the density in the weft direction, it is required to increase the count of wefts. When a conventional weaving machine is used, however, the loosening of warps takes place after a beating, and the increasing of the stroke number has a physical limit.

In contrast, in the present invention, the tension of the warp is increased up to a level well over a conventionally believed level, and the weft is inserted while the warps are in a tense state. Therefore, the loosening of the warps does not take place, and the density of a textile fabric can be increased while maintaining the warp/weft balance.

The weaving machine used in the present invention is not specially limited, and it can be selected from a normal loom weaving machine and others such as a water Jet loom weaving machine and an air jet loom weaving machine.

Further, the texture design is not limited, either, and it is selected from a plain weave and others such as a twill weave and a satin.

The woven textile fabric is preferably scoured, relaxed, preset, dyed, optionally treated to impart it with water repellency, and then calendered according to conventional methods.

The treatment for imparting water repellency can be carried out by imparting a fluorine-containing or a silicon-containing water repellent by a spray method, a padding method or a dipping method. In this case, the amount of the water repellent adhering to the textile fabric is preferably 15 to 80% by weight.

Further, it is preferred to increase the infiltration of the water repellent by adding an infiltration improving agent such as isopropyl alcohol to the treating bath or by treating the above woven textile fabric for a longer period of time than a period of time for which a usual textile fabric is treated.

The so-obtained textile fabric has a tearing strength of at least 1,000 g in each of the warp and weft directions, which tearing strength is well over those of conventional textile fabrics, and after the above treatment for imparting water repellency, it shows high resistance to water pressure as high as 1,000 mm water column.

As described above, the high-density textile fabric of the present invention has its characteristic feature in that it has sufficiently high resistance to water pressure based on the structure of the textile fabric without forming any water-repellent coating on the fabric surface.

EXAMPLES

The present invention will be more specifically explained hereinafter with reference to Examples. Physical properties in Examples were measured by the following methods.

(1) Cross-sectional overlaying coefficients, $W_p$ and $W_f$, of warps and wefts The following $W_{of}$, $W_{1f}$, $W_{0p}$ and $W_{1p}$ were read from micrographs of cross sections arbitrarily taken from a textile fabric in the warp and weft directions, and the above coefficients were calculated on the basis of the following equations.

$W_{0f}$: a width of minimum repeating units in a cross section of a textile fabric along a bisecting line in the length direction of any wefts in the minimum repeating units of the textile fabric, e.g., a width of 2 warps when the textile fabric is a plain weave, a width of 4 warps when it is a 2/2 twill weave, and a width of 5 warps when it is a 5-harness satin, provided that said width refers to an average value of those in three different repeating units.

$W_{1f}$: a sum of widths of warps contained in the minimum repeating units in the cross section of the above $W_{of}$, provided that said width refers to an average value of those in three different repeating units.

$W_{0p}$: a width of minimum repeating units in a cross section of a textile fabric along a bisecting line in the length direction of any warps in the minimum repeating units of the textile fabric, e.g., a width of 2 warps when the textile fabric is a plain weave, a width of 4 warps when it is a 2/2 twill weave, and a width of 5 warps when it is a 5-harness satin, provided that said width refers to an average value of those in three different repeating units.

$W_{1p}$: a sum of widths of wefts contained in the minimum repeating units in the cross section of the above $W_{of}$, provided that said width refers to an average value of those in three different repeating units.

$$W_p = W_{1f}/W_{0f}$$

$$W_f = W_{1p}/W_{0p}$$

(2) Tearing strength of textile fabric

According to the single tongue method of L 1079 A1, a textile fabric was measured in the warp and weft directions five times each, and an average value was taken as such. The tearing strength in the warp direction refers to a tearing force required for tearing wefts along the warp direction of a textile fabric.

(3) Resistance to water pressure

According to the low water pressure method of JIS L 1092, a textile fabric was measured five times, and an average value was taken as such. Further, a textile fabric which had been wasted five times was also measured for resistance to water pressure in the same manner. The washing conditions were according to the JIS L 1018–77 6.36H method.

Example 1

A flat yarn of polyester multifilaments of 100-denier 288 filaments, having a twist number S of 300 T/m, was used as warps, and an untwisted flat yarn of polyester multifilaments of 64-denier 144 filaments was used as wefts. A plain weave was produced from the above yarns with a water Jet loom weaving machine of which the press roller had a diameter of 150 mm and the back roller had a diameter of 160 mm, at a tension, per warp, of 0.5 g/denier.

In this case, the warp density was set at 144 yarns/inch and the weft density was set at 117 yarns/inch.

The above-obtained textile fabric was scoured, preset, then dyed with a liquid flow dyeing machine, and dried.

The dried textile fabric was finished as follows. It was immersed in a bath containing the following components, and adjusted to have a pick-up amount of 60% by weight. Then, the resultant textile fabric was heat-set and calendered at 160° C.

Fluorine-containing water repellent (Asahi Guard LS317; supplied by Asahi Glass Co., Ltd.) 5.0 wt %

Fluorine-containing water repellent (Asahi Guard LS380K; supplied by Asahi Glass Co., Ltd.) 0.3 wt %

Isopropyl alcohol 3.0 wt %.

The so-obtained high-density textile fabric had a $W_p$ of 1.14 and a $W_f$ of 0.91. Table 1 shows the tearing strength and water pressure resistance of the obtained textile fabric.

Example 2

A textile fabric was produced and finished in the same manner as in Example 1 except that the warps were replaced with false-twisted yarns of polyester multifilaments of 100-denier 288 filaments, having a twist number S of 300 T/m, that the warp density was set at 140 yarns/inch and that the weft density was set at 112 yarns/inch.

Table 1 shows the $W_p$, $W_f$, tearing strength and water pressure resistance of the obtained textile fabric.

Example 3

A textile fabric was produced and finished in the same manner as in Example 1 except that the warps and wefts were replaced with commingled yarns (twist number S 300 T/m. constitution ratio of fibers having a filament denier of 1.1 or less 52%) of 62-denier 84 filaments formed of polyester multifilament flat yarns of two types having different boiling water shrinkage, that the warp density was set at 178 yarns/inch and that the weft density was set at 112 yarns/inch.

Table 1 shows the $W_p$, $W_f$, tearing strength and water pressure resistance of the obtained textile fabric.

Example 4

A textile fabric was produced and finished in the same manner as in Example 1 except that the warps and wefts were replaced with commingled yarns (twist number S 300 T/m, constitution ratio of fibers having a filament denier of 1.1 or less 40% ) of 62-denier 84 filaments formed of polyester multifilament flat yarns of two types having different boiling water shrinkage, that the warp density was set at 170 yarns/inch and that the weft density was set at 142 yarns/inch.

Table 1 shows the $W_p$, $W_f$, tearing strength and water pressure resistance of the obtained textile fabric.

Example 5

A textile fabric was produced and finished in the same manner as in Example 1 except that the weaving machine was replaced with an air jet loom weaving machine, that the warp density was set at 144 yarns/inch and that the weft density was set at 135 yarns/inch.

Table 1 shows the $W_p$, $W_f$, tearing strength and water pressure resistance of the obtained textile fabric.

Example 6

A textile fabric was produced and finished in the same manner as in Example 1 except that the warp density was set at 158 yarns/inch and that the weft density was set at 120 yarns/inch.

Table 1 shows the $W_p$, $W_f$, tearing strength and water pressure resistance of the obtained textile fabric.

Comparative Example 1

An attempt was made to produce a textile fabric in the same manner as in Example 3 except that the weaving machine was replaced with a conventional water Jet loom weaving machine and that the tension per warp was changed to 0.11 g/denier. However, the weaving machine frequently stopped, and no high-density textile fabric was obtained.

Comparative Example 2

A textile fabric was produced and finished in the same manner as in Comparative Example 1 except that the warp density was set at 132 yarns/inch and that the weft density was set at 96 yarns/inch.

Table 1 shows the $W_p$, $W_f$, tearing strength and water pressure resistance of the obtained textile fabric.

Comparative Example 3

A textile fabric was produced and finished in the same manner as in Example 1 except that the warp density was set at 116 yarns/inch and that the weft density was set at 90 yarns/inch.

Table 1 shows the $W_p$, $W_f$, tearing strength and water pressure resistance of the obtained textile fabric.

Comparative Example 4

A textile fabric was produced and finished in the same manner as in Example 1 except that the warps were replaced with false-twisted yarns of polyester of 80-denier 72 filaments, that the wefts were replaced with a flat yarn of polyester multifilaments of 75-denier 72 filaments, that the warp density was set at 138 yarns/inch and that the weft density was set at 98 yarns/inch.

Table 1 shows the $W_p$, $W_f$, tearing strength and water pressure resistance of the obtained textile fabric.

Comparative Example 5

A textile fabric was produced and finished in the same manner as in Example 1 except that the warps and wefts were replaced with commingled yarns (twist number S 150 T/m, constitution ratio of fibers having a filament denier of 1.1 or less 38%) of 130-denier 120 filaments formed of polyester multifilament flat yarns of two types having different boiling water shrinkage, that the warp density was set at 106 yarns/inch and that the weft density was set at 60 yarns/inch.

Table 1 shows the $W_p$, $W_f$, tearing strength and water pressure resistance of the obtained textile fabric.

TABLE 1

| | | Ex. 1 | Ex. 2 | Ex. 3 | Ex. 4 | Ex. 5 | Ex. 6 |
|---|---|---|---|---|---|---|---|
| Constitution Ratio of filament having denier of 1.1 or less (wt %) | Warp | 100 | 100 | 52 | 40 | 100 | 100 |
| | Weft | 100 | 100 | 52 | 4 | 100 | 100 |
| Total denier | Warp | 100 | 100 | 62 | 62 | 100 | 100 |
| | Weft | 64 | 64 | 62 | 62 | 64 | 64 |
| Weaving density | Warp | 144 | 140 | 178 | 170 | 144 | 152 |
| | Weft | 117 | 112 | 112 | 144 | 135 | 120 |
| $W_p$ | | 1.14 | 1.10 | 1.116 | 11.14 | 11.18 | 11.25 |
| $W_f$ | | 0.91 | 0.85 | 0.890 | 18.20 | 18.08 | 08.92 |
| Tearing strength (g) | Warp | 1,500 | 1,100 | 1,300 | 2,000 | 1,600 | 1,100 |
| | Weft | 2,900 | 2,400 | 2,400 | 2,800 | 3,050 | 3,000 |
| Resistance to water pressure (mm) | Initial | 2,030 | 1,150 | 1,450 | 2,000 | 2,300 | 1,050 |
| | After washed 5 times | 1,920 | 1,100 | 1,340 | 1,950 | 2,070 | 1,020 |

| | | CEx. 1 | CEx. 2 | CEx. 3 | CEx. 4 | CEx. 5 |
|---|---|---|---|---|---|---|
| Constitution Ratio of filament having denier of 1.1 or less (wt %) | Warp | 52 | 52 | 100 | 0 | 38 |
| | Weft | 52 | 52 | 100 | 100 | 38 |
| Total denier | Warp | 62 | 62 | 100 | 80 | 130 |
| | Weft | 62 | 62 | 64 | 75 | 1304 |
| Weaving density | Warp | * | 132 | 116 | 138 | 106 |
| | Weft | | 98 | 90 | 98 | 60 |
| $W_p$ | | | 1.12 | 0.98 | 1.14 | 1.14 |
| $W_f$ | | | 0.80 | 0.86 | 0.88 | 0.93 |
| Tearing strength (g) | Warp | | 900 | 1,020 | 1,100 | 1,200 |
| | Weft | | 2,500 | 960 | 2,600 | 2,850 |
| Resistance to water pressure (mm) | Initial | | 600 | 800 | 700 | 550 |
| | After washed 5 times | | 500 | 600 | 600 | 500 |

Ex. = Example
CEx. = Comparative Example
*Impossible to produce

EFFECTS OF THE INVENTION

The high-density textile fabric of the present invention not only exhibits high tearing strength but also has excellent water resistance performance although it has a small thickness and a light weight. Therefore, it can be widely used not only as a closing material for ski wear, windbreakers, outdoors wear, coats, working clothes and operating gowns, but also for a shower curtain, a table cloth and a piece of cloth for an umbrella.

We claim:

1. A high-density textile fabric produced by arranging, as warps and wefts, identical or different continuous filaments yarn at least 40% by weight of which are formed of filaments having a filament denier of 1.1 or less and which have a total denier of 120 or less, wherein cross-sectional overlaying coefficients, $W_p$ and $W_f$, of the warps and wefts constituting said textile fabric simultaneously satisfy the following (a) and (b), (a) $1.30 \geqq W_p \geqq 1.10$ (b) $1.20 \geqq W_F \geqq 0.85$ (wherein the cross-sectional overlaying coefficients, $W_p$ and $W_f$, are defined as follows;

$W_{p=w1f}/W_{0f}$ $W_{f=w1p}/W_{0p}$ $W_{0f}$: a width of minimum repeating units in a cross section of a textile fabric along a bisecting line in the length direction of any wefts in the minimum repeating units of the textile fabric, $W_{1f}$: a sum of widths of warps contained in the minimum repeating units in the cross section of the above $W_{0f}$, $W_{0p}$: a width of minimum repeating units in a cross section of a textile fabric along a bisecting line in the length direction of any warps in the minimum repeating units of the textile fabric, $W_{1p}$: a sum of widths of wefts contained in the minimum repeating units in the cross section of the above $W_{0f}$.

2. The high-density textile fabric of claim 1, wherein the textile fabric has a tearing strength of at least 1,000 g in both of warp and weft directions.

3. The high-density textile fabric of claim 1, wherein the textile fabric is a product which is treated for imparting the textile fabric with water repellency and has a water pressure resistance of 1,000 mm water column.

4. The high-density textile fabric of claim 1, wherein the textile fabric has a $(W_p - W_f)$ value of 0.3 or less.

5. The high-density textile fabric of claim 1, wherein the continuous filaments yarn are multifilaments formed of a polyester.

6. The high-density textile fabric of claim 1, wherein at least one of filaments of the continuous filaments yarn is a substantially untwisted flat yarn of a polyester multifilament.

7. The high-density textile fabric of claim 5, wherein the warps or the wefts are formed of a false twisted yarn of a polyester multifilament.

8. The high-density textile fabric of claim 1, wherein the continuous filaments yarn contain less than 40% by weight of filaments having a filament denier of more than 1.1 but 3 or less.

9. The high-density textile fabric of claim 1, wherein the continuous filaments yarn contain less than 40% by weight of filaments having a filament denier of more than 1.1 but 2 or less.

10. The high-density textile fabric of claim 1, wherein the textile fabric has a total of cover factors (CF) in the warp and weft directions in the range of from 1,800 to 3,500.

11. A clothing produced from the high-density textile fabric as recited in claim 1.

* * * * *